US007044985B2

(12) United States Patent
Rizzardi et al.

(10) Patent No.: US 7,044,985 B2
(45) Date of Patent: May 16, 2006

(54) PROCESS FOR PRE-TREATING CELLULOSIC FIBERS AND CELLULOSIC FIBER BLENDS

(75) Inventors: Angelo Rizzardi, Charlotte, NC (US); Michael Grigat, Rome, GA (US)

(73) Assignee: Clariant Finance (BVI) Limited, Tortola (VG)

( * ) Notice: Subject to any disclaimer, the term of this patent is extended or adjusted under 35 U.S.C. 154(b) by 0 days.

(21) Appl. No.: 09/738,623

(22) Filed: Dec. 15, 2000

(65) Prior Publication Data

US 2002/0007515 A1 Jan. 24, 2002

Related U.S. Application Data

(60) Provisional application No. 60/286,986, filed on Dec. 21, 1999.

(51) Int. Cl.
*C11D 7/54* (2006.01)
*C11D 3/04* (2006.01)
*C09K 3/00* (2006.01)

(52) U.S. Cl. ..... 8/115.51; 8/111; 252/8.84; 252/391; 252/392; 252/398; 510/437

(58) Field of Classification Search ..... 8/116.1, 8/181, 127; 510/437; 252/90–99
See application file for complete search history.

(56) References Cited

U.S. PATENT DOCUMENTS

| | | | | |
|---|---|---|---|---|
| 4,025,453 | A * | 5/1977 | Kravetz et al. | 252/186.38 |
| 4,186,186 | A | 1/1980 | Tesmann et al. | 424/62 |
| 4,359,007 | A | 11/1982 | Muck | 112/25 |
| 4,430,243 | A * | 2/1984 | Bragg | 252/186.33 |
| 5,021,187 | A | 6/1991 | Harriott et al. | 252/186.38 |
| 5,536,441 | A * | 7/1996 | Chapple et al. | 252/186.33 |
| 5,562,740 | A | 10/1996 | Cook et al. | 8/120 |
| 5,653,910 | A | 8/1997 | Kerschner et al. | 252/186.38 |
| 5,698,507 | A | 12/1997 | Gorlin et al. | 510/223 |
| 5,785,886 | A | 7/1998 | Kerschner et al. | 252/186.33 |
| 6,395,701 | B1 * | 5/2002 | Connor et al. | 510/437 |

FOREIGN PATENT DOCUMENTS

| | | | |
|---|---|---|---|
| EP | 0 369 711 | | 5/1990 |
| EP | 0 449 797 | | 10/1991 |
| EP | 0585038 | * | 8/1992 |
| EP | 0 585 038 | | 3/1994 |
| EP | 1 038 947 | | 9/2000 |
| GB | 984459 | * | 3/1962 |
| GB | 984459 | | 2/1965 |

OTHER PUBLICATIONS

A.J. Matthews, et al., "Use of T.A.E.D. in the bleaching of cellulosics to improve fibre quality", Warwick International Group Limited, Flintshire, UK, 1998.
Jane Matthews, "A new approach to textile bleaching", JSDC, vol. 115, May/Jun. 1999, pp. 154-155.
PCT Search Report for application No. 00/01937, mail date Sep. 24, 2001.
English abstract for RU 2026433, Jan. 10, 1995.
Ming G., et al., "Treating Fabric Through Alkaline Oxidation for a Silk-Like Effect" American Dyestuff Reporter, SAF International Publications, Secausus, US, vol. 85, No. 7, Jul. 1, 1996, p. 20,22-24,26, XP000598049.
English abstract for SU 691511, Oct. 15, 1997.

* cited by examiner

*Primary Examiner*—Yogendra N. Gupta
*Assistant Examiner*—Preeti Kumar
(74) *Attorney, Agent, or Firm*—Tod A. Waldrop

(57) ABSTRACT

A process and formulation for pre-treating a cellulosic, or cellulosic blend with synthetic fiber, substrate, achieving sufficient clearness and appropriate absorbency prior to dyeing the substrate. The process having the steps of: providing a vessel; providing a cellulosic, or their blends with synthetic fiber, substrate; providing a water bath; adding an active amount of an activating compound selected from the group of: salts of organic acids, organic amine derivatives, transitional metals salts and complexes, pigments, and combinations thereof; adding an active amount of caustic soda; adding an active amount of hydrogen peroxide; achieving a pH from about 6.0 to about 9.0 at the end of the bleaching cycle; heating the water bath to a temperature in excess of 50 degrees centigrade for a predetermined period of time; and dropping the bath.

3 Claims, No Drawings

PROCESS FOR PRE-TREATING CELLULOSIC FIBERS AND CELLULOSIC FIBER BLENDS

CROSS REFERENCE TO RELATED APPLICATION

This application claims the benefit of U.S. Provisional Application No. 60/286,986 filed Dec. 21, 1999.

FIELD OF THE INVENTION

The present invention is directed to a new process for pre-treating cellulosic fibers and cellulosic fiber blends with synthetic fibers, eliminating the need for rinses or significantly reducing the amount of rinsing necessary.

BACKGROUND OF THE INVENTION

A typical example of the preparation for dyeing of 100% cotton materials includes:

Exhaust Procedure:

a) bath composition

| | | |
|---|---|---|
| 0.5–2.0 g/l | Wetting Agent/Detergent: | nonionic and/or anionic surfactants |
| 0.3–0.6 g/l | Peroxide Stabilizer: | organo-phosphate based (e.g., diethylenetriamine pentamethylene phosphonic acid (DTPMP)) and/or amino-organic acid based (e.g., diethylenetriamine pentaacetic acid (DTPA)) and/or polyacrylic acid based and/or organic acid based (e.g., sodium salt of gluconic Acid) and/or silicate based and/or earth alkaline salts (e.g., $MgCl_2$) |
| 1.5–3.0 g/l | Caustic Soda (100%) | |
| 1.5–3.0 g/l | Hydrogen Peroxide (100%) | |

a) typical application:

Cellulosic material is loaded into an exhaust dyeing machine or apparatus (e.g., Jet Dyeing machine, winch, package machine, beam etc.). The machine is filled with water and possibly with a wetting agent to produce a bath before a material load is introduced to the machine. The water amount is typically calculated based on the weight of the material load and expressed in a liquor ratio. A typical liquor ratio is 1:10, or for 1 kg fabric, 10 l liquid are used.

Subsequent to loading the machine, the remaining chemicals are added and the resulting bath is heated to a suitable temperature, typically 98° C.–110° C. Depending on the construction of the machine/apparatus, material and/or liquor is moved to ensure homogeneous and efficient pre-treatment.

The bath is then cooled and dropped, or drained, after a treatment time of 15–30 min. Multiple rinses and/or overflow washes of the cellulosic material are necessary to remove impurities and especially residual alkalinity in the material that otherwise would harm or interfere with the effectiveness of subsequent processes.

Alkalinity, typically provided by caustic soda, is considered necessary to activate the oxidizing component, hydrogen peroxide, and to saponify waxes and other fatty based cotton byproducts allowing easier removal of these impurities. This process of pre-treating cellulosic material is commonly referred to as a bleaching cycle that occurs prior to the dyeing of the material.

SUMMARY OF THE INVENTION

The present invention is a process for pre-treating a cellulosic, or cellosic blends with synthetic fiber, substrate. In a most basic form, the invented pre-treating process of cellulosic, or cellulosic blends, substrate is a bleaching cycle comprising the steps of: providing a vessel; providing the cellulosic, or their blends with synthetic fiber, substrate; providing a water bath; adding an active amount of an activating compound selected from the group of: salts of organic acids, organic amine derivatives, transitional metals, transitional metal salts and transitional metal complexes, pigments and combinations thereof; adding an active amount of caustic soda; adding an active amount of hydrogen peroxide during the bleaching cycle; achieving a pH from about 6.0 to about 9.0 at the end of the bleaching cycle pretreatment process; heating the water bath to a temperature in excess of 50 degrees centigrade for a pre-determined period of time; and, dropping the bath.

DESCRIPTION OF THE INVENTION

The present invention is an innovative and novel process and composition for pre-treating a cellulosic, or cellulosic blends with synthetic fiber, substrate that eliminates or greatly reduces the need for rinses. The invented process is ideally used as a pre-treatment process of cellulosic, or cellulosic blended fibers or materials, prior to dyeing the same. Using the invented process, significant amounts of water, waste-water, energy, and process time are saved. Furthermore, the invented process affords additional machine capacity.

In the invented process and composition, significant amounts of alkali that are normally used in conventional processes are replaced by alternative chemicals and chemical systems leading to a well prepared cellulosic, or cellulosic blends with synthetic fiber, substrate (e.g., cotton) that does not require rinsing after a bleach application. This can be achieved due to a resulting neutral or nearly neutral final pH and sufficient cleanliness of the prepared goods. The cleanliness is indicated by a degree of water absorption and whiteness as well as by visual aspect (removal of seeds) of the bleach goods.

Alternatives to a commonly used alkali caustic soda include but are not limited to: alkali salts of organic acids, preferably Trisodiumcitrate; transition metal salts and complexes, preferably Copper salts and complexes; organic activators, preferably Urea, Dicyandiamid or Tetraacetylethylenediamine, Acetyl Caprolactam; pigments, preferably pigmented Sulfur Black 1 with a particle size less than 150 μm or Titanium Dioxide with a particle size less than 150 μm; and, combinations thereof.

If used within pre-determined parameters, described in greater detail hereinafter, none to a very acceptable degree of damage of cellulosic, or cellulosic blends with synthetic fiber, substrate is expected. Use of earth-alkaline salts, preferably Mg salts (e.g., $MgSO_4$) have a stabilizing function. For example, the earth-alkaline salts prevent premature and uncontrolled destruction of hydrogen peroxide that could lead to insufficient bleach results and fiber damage.

The present invention is a process for pre-treating a cellulosic, or cellulosic blends with synthetic fiber, substrate having the steps of: providing a vessel; providing the cellulosic, or cellulosic blends with synthetic fiber, substrate; providing a water bath; adding an active amount of an activating compound selected from the group of: salts of organic acids, organic amine derivatives, transitional metals, pigments with a particle size less than 150 μm, and combinations thereof; adding an active amount of caustic soda; adding an active amount of hydrogen peroxide during a bleaching cycle; achieving a pH from about 6.0 to about 9.0 at the end of the bleaching cycle; heating the water bath to a temperature in excess of 50 degrees centigrade for a period of time; and dropping the bath.

When the activating compound is a salt of an organic acid, some examples that have been found to work well include, but are not limited to: sodium salts of citric acid; sodium stearate; sodium salts of gluconic acid; sodium oleate; potassium salt of citric acid; potassium stearate; potassium salt of gluconic acid; potassium oleate; ammonium salts of citric acid; ammonium stearate; ammonium salts of gluconic acid; ammonium oleate; and, combinations thereof. Preferably about 0.2 to about 5.0% based on the weight of the substrate, hereinafter referred to as "owg", of the salt of an organic acid is used.

When the activating compound is an organic amine derivative, some examples that have been found to work well include, but are not limited to: urea; dicyandiamid; tetra-acetyl-ethylene-di-amine; acetyl-caprolactam; and, combinations thereof. Preferably about 0.2 to about 5.0% owg of the organic amine derivative is used.

When the activating compound is a transitional metal salt or complex, some examples that have been found to work well include, but are not limited to: copper gluconate; copper sulfate; copper acetate; copper carbonate; copper citrate; copper nitrate; copper EDTA; copper complexes; and, combinations thereof. When Copper compounds are used as the transitional metal salt or complex, preferably about 0.1 to about 10 ppm based on the weight of the bath, hereinafter referred to as "owb", based on the element Copper is used.

When the activating compound is a pigment, some examples that have been found to work well include, but are not limited to: pigmented Sulfur Black 1 with a particle size less than 150 μm; fully pre-oxidized sulfur dyes, such as Diresul Black 4G-EV or Titanium Dioxide and, combinations thereof. Fully pre-oxidized sulfur dyes or Titanium Dioxide are preferably selected because the bleach-white base as well as the visual white appearance of the substrate is synergistically improved by the use thereof. Preferably about 1 to about 200 ppm owb of pigment is used.

When caustic soda is added, from about 0.1 to about 1.0% owg is preferably used. When hydrogen peroxide is added, the amount depends on the desired whitening effects but preferably ranges between about 0.5 to about 5.0% owg.

In the invented process for pre-treating a cellulosic, or cellulosic blends with synthetic fiber, substrate, the water bath is preferably heated to a temperature ranging from about 80 degrees centigrade to about 140 degrees centigrade. The substrate is held within this temperature range for a period ranging from about 0.5 second to about one hour. In an alternative procedure, a temperature point may be predetermined, and the bath heated until such point is reached. Then the bath is simply cooled. In this alternative procedure, the length of time in the temperature range would be greater than 0.5 seconds.

In the invented process, an active amount, for example from about 0.1 to about 1.5% owg, of a wetting and/or scouring compound is optionally used. An example of a wetting agent is an ethoxylated and/or propoxylated fatty alcohol, and an example of a scouring agent is an ethoxylated and/or propoxylated fatty alcohol. While this type of scouring or wetting agent has been found to perform well, many other types of conventional scouring or wetting agents may also be employed. An active amount, for example from about 0.1 to about 1.5% owg, of a peroxide stabilizing compound is preferably added to the bath. Examples of peroxide stabilizing agents include, but are not limited to: organo-phosphate based agents (e.g., Diethylenetriamine penta(methylene phosphonic acid)); amino-organic acid based agents (e.g., Diethylenetriamine pentaacetic acid); organic acid based agents (e.g., Sodium salt of Gluconic Acid); polyacrylic acid based agents; earth alkaline salts (e.g., $Mg^{+2}$ salts); and, combinations thereof.

In the invented process for pre-treating cellulosic, or cellulosic blends with synthetic fiber, substrate, achieving a near neutral pH enables a reduction or elimination of the need for subsequent water baths. During the invented process, the bath starts with a slightly alkali pH. As the invented process progresses, a pH of about 6.0 to about 9.0, and preferably from about 6.5 to about 8.5, is achieved.

EXAMPLES

Typical examples for the new process are:

1 kg of 100% cotton knit material was loaded in a laboratory jet-dyeing machine. The machine was filled with water, non-foaming wetting agent/detergent before the load. Chosen liquor ratio was 1:10 such that 10 l treatment liquor were used. Subsequent to loading the machine remaining chemicals were added and bath was heated up to 110° C. (4° C./min). Treatment time at this temperature was 20 minutes followed by a cooling phase to 75° C. (4° C./min). Finally, the bath was dropped and the fabric was centrifuged, dried and analyzed.

In a production process, the bath would be refilled after the drop, and a peroxidase (catalase) (enzymatic peroxide eliminator) would be added to remove residual peroxide. The subsequent process (e.g., dyeing) can start in the same bath.

Formulas for the treatment bath (concentrations in % on the weight of the substrate (owg) if not stated otherwise):

TABLE 1

| | 1 | 2 | 3 | 4 | 5 | Untreated goods |
|---|---|---|---|---|---|---|
| Non-foaming scouring/ wetting agent | 0.7 | 0.7 | 0.7 | 0.7 | 0.7 | |
| Peroxide Stabilizer | 0.5 | 0.5 | 0.5 | 0.5 | 0.5 | |
| Trisodium Citrate | 2 | 2 | 1 | | | |
| Copper Gluconate (ppm Cu owb) | | 0.8 | | | | |
| Urea | | | 5 | | | |
| Hydrogen Peroxide (50%) | 3 | 3 | 3 | 3 | 3 | |
| Caustic Soda (50%) | 0.4 | 0.4 | 0.3 | 4 | 0.4 | |
| Initial Ph of bath | 10.5 | 10.2 | 9.7 | 11.5 | 10.1 | |
| Final Ph of bath | 7.9 | 7.2 | 7.8 | 10.5 | 7.9 | |

Treatment 4 (Table 1) represents a typical prior art bleach. A final pH of 10.5, such as in the prior art bleach of Treatment 4 (Table 1), requires multiple rinses. Treatment 5 (Table 1) represents a low alkali pretreatment without any activator. The following results, shown in Table 2, demonstrate that the presence of various activators allows bleaching with an excellent level of absorbency and a suitable level of clearness while using significantly lower amounts of alkali than conventional processes.

TABLE 2

Results for different fabric styles: a) 100% cotton interlock knit
b) 100% cotton haring-bone knit
c) 100% cotton jersey knit
d) 100% cotton piquet knit

| Results of Treatment Nos. from Table 1: | 1 | 2 | 3 | 4 | 5 | Untreated goods |
|---|---|---|---|---|---|---|
| Fabric a: | MG 1-2 | MG 1-3 | | MG 1-1 | | |
| Whiteness (CIE) | 64 | 69 | | 70 | | 7 |
| Visual Cleanliness (Seeds, etc.) | Very clean | Very clean | | Very clean | | Not clean |
| Water drop absorbency | Very high | Very high | | High | | None |
| Burst Strength (lbs./in$^2$) | 124 | 115 | | 124 | | 137 |
| Average degree of polymerization EWN-method | 3000 | 2300 | | 3000 | | 3000 |
| Fabric b: | EK 19-2 | EK 19-4 | EK 19-3 | EK 19-1 | EK 30-1 | |
| Whiteness (CIE) | 60 | 66 | 63 | 72 | 54 | 8 |
| Visual Cleanliness (Seeds, etc.) | Very clean | Very clean | Very clean | Very clean | Not clean | Not clean |
| Water drop absorbency | Very high | Very high | Very high | High | None/ Low | None |
| Average degree of polymerization EWN-method | 2700 | 2200 | 2700 | 2900 | | 3000 |
| Fabric c: | EK 19-2 | EK 19-4 | EK 19-3 | EK 19-1 | | |
| Whiteness (CIE) | 61 | 69 | 64 | 71 | | 28 |
| Visual Cleanliness (Seeds, etc.) | Very clean | Very clean | Very clean | Very clean | | Not Clean |
| Water drop absorbency | Very high | Very high | Very high | High | | None |
| Average degree of polymerization EWN-method | 2600 | 2300 | 2600 | 2700 | | 3000 |
| Fabric d: | EK 19-2 | EK 19-4 | EK 19-3 | EK 19-1 | | |
| Whiteness (CIE) | 57 | 66 | 62 | 68 | | |
| Visual Cleanliness (Seeds, etc.) | Very clean | Very clean | Very clean | Very clean | | Not Clean |
| Water drop absorbency | Very high | Very high | Very high | High | | None |
| Average degree of polymerization EWN-method | 2700 | 2300 | 2500 | 2700 | | Est. 3000 |

| Average value of polymerization (DP): | | |
|---|---|---|
| <1800 | Poor | Depending on greige fabric DP |
| 1800–2000 | Good | |
| 2000–2400 | Very good | |
| >2400 | Excellent | |

TABLE 3

| | MG 11-7 | MG 11-2 | MG 11-3 | MG 11-4 |
|---|---|---|---|---|
| Non-foaming scouring/wetting agent | 0.7 | 0.7 | 0.7 | 0.7 |
| Peroxide Stabilizer | 0.5 | 0.5 | 0.5 | 0.5 |
| Trisodium Citrate | | 2 | | 2 |
| Tetra Acetyl Ethylene Diamine (TAED) | | | | 1 |
| Hydrogen Peroxide (50%) | 3 | 3 | 3 | 3 |
| Caustic Soda (50%) | 4 | 0.4 | 0.4 | 1(*) |
| Treatment Time at 110° C. (min.) | 15 | 15 | 15 | 15 |
| Initial pH of bath | 12.0 | 11.0 | 10.7 | 11.0 |
| Final pH of bath | 11.0 | 7.8 | 7.3 | 7.4 |
| Results on 100% cotton interlock knit: | | | | |
| Whiteness (CIE) after treatment | 72.7 | 57.9 | 54.7 | 65.9 |
| Hydrophilicity | High | Very high | poor | Very high |

(*)more alkali was used to compensate for the acid nature of TAED. Final pH was still in a range where nearly all cotton dye-procedures can be started without the need for prior rinses.

Treatment MG 11-7 (Table 3) represents a typical prior art bleach. The final pH of 11.0 of the prior art bleach (Treatment MG 11-7, Table 3) requires multiple rinses. Treatment MG 11-3 (Table 3) represents a bleach without the addition of any described activating compounds. Treatment MG 11-3 (Table 3) expectedly yields unacceptable whiteness and absorbency levels. The addition of activating compound Trisodium Citrate (Treatment MG 11-2, Table 3) and Trisodium Citrate plus Tetra Acetylen Ethylene Diamine (Treatment MG 11-4, Table 3) results in a preparation of cotton substrate in accordance with the present invention that is suitable for subsequent dyeing operations without additional rinse requirement.

Formulas for the treatment bath (concentrations in % owg if not stated otherwise):

TABLE 4

| | 1 | 2 | 3 | 4 | 5 | 6 | 7 | 8 | 9 |
|---|---|---|---|---|---|---|---|---|---|
| Non-foaming scouring/wetting agent | 0.7 | 0.7 | 0.7 | 0.7 | 0.7 | 0.7 | 0.7 | 0.7 | 0.7 |
| Peroxide Stabilizer | 0.5 | 0.5 | 0.5 | 0.5 | 0.5 | 0.5 | 0.5 | 0.5 | 0.5 |
| Trisodium Citrate | 2 | 1.5 | 2 | 2 | 1.5 | 1.5 | | 2 | |
| Copper Gluconate (ppm Cu owb) | 0.5 | 0.5 | | | | | | 0.8 | 0.5 |
| Sulfur Black 1 (ppm owb) | 5 | 5 | | 5 | 5 | | | | 5 |
| Hydrogen Peroxide (50%) | 3 | 3 | 3 | 3 | 3 | 3 | 3 | 3 | 3 |
| Caustic Soda (50%) | 0.4 | 0.4 | 0.4 | 0.4 | 0.4 | 0.4 | 4 | 0.4 | 0.4 |
| Treatment Time at 110° C. (min.) | 30 | 30 | 30 | 30 | 30 | 30 | 30 | 30 | 30 |
| Initial pH of bath | 10.4 | 9.7 | 9.7 | 9.7 | 9.7 | 9.7 | 11.0 | 9.7 | 10.0 |
| Final pH of bath | 6.9 | 6.9 | 7.2 | 7.3 | 7.6 | 7.5 | 10.5 | 7.0 | 6.9 |
| Residual Hydrogen Peroxide (%) | 43 | 43 | 69 | 75 | 75 | 70 | 75 | 34 | 46 |
| Results on 100% cotton interlock knit: | | | | | | | | | |
| Whiteness (CIE) after treatment | 66.9 | 66.5 | 60.3 | 61.2 | 59.4 | 60.4 | — | 67.7 | 67.6 |
| Whiteness (CIE) after one rinse with water | 68.6 | 65.8 | 60.6 | 62.8 | 61.3 | 60.7 | 73.4 | 67.5 | 69.0 |
| Comments | | | | | | | | | |
| Hydrophilicity | Very high | Very high | High | Fair | Fair | High | High | Very high | Very high |

Treatment 7 (Table 4) represents a typical prior art bleach. The final pH of 10.5 of Treatment 7 (Table 4) requires multiple rinses. All other treatments in accordance with the present invention, shown in Table 4, demonstrate sufficient preparation for most dye processes without the need for rinsing. The addition of Sulfur Black 1 (Treatment 4, Table 4) has improved whiteness levels in comparison to the sole use of Trisodium citrate (Treatment 3, Table 4). Further addition of copper gluconate (Treatments 1, 2, 8 and 9, Table 4) enhances whiteness more and creates a very absorbent substrate. The hydrogen peroxide utilization increases significantly with the use of copper gluconate.

(concentrations in % owg if not stated otherwise)

TABLE 5

| | SS-3-13-1 | SS-3-13-2 | SS-3-13-3 | SS-3-13-4 |
|---|---|---|---|---|
| Non-foaming scouring/wetting agent | 0.7 | 0.7 | 0.7 | 0.7 |
| Peroxide Stabilizer | 0.5 | 0.5 | 0.5 | 0.5 |
| Trisodium Citrate | 2 | 2 | 2 | 2 |
| Copper Gluconate (ppm Cu owb) | | 0.5 | 0.5 | |
| Sulfur Black 1 (ppm owb) | | | 5 | 5 |
| Hydrogen Peroxide (50%) | 3 | 3 | 3 | 3 |
| Caustic Soda (50%) | 0.4 | 0.4 | 0.4 | 0.4 |
| Treatment Time at 110° C. (min.) | 30 | 30 | 30 | 30 |
| Initial pH of bath | 10.4 | 9.8 | 9.8 | 9.9 |
| Final pH of bath | 7.4 | 7.0 | 7.2 | 7.6 |
| Residual Hydrogen Peroxide (%) | 65 | 51 | 36 | 68 |
| Results on 100% cotton interlock knit: | | | | |

TABLE 5-continued

| | SS-3-13-1 | SS-3-13-2 | SS-3-13-3 | SS-3-13-4 |
|---|---|---|---|---|
| Whiteness (CIE) after treatment | 57.1 | 59.7 | 63.2 | 58.6 |
| Hydrophilicity | High | Very high | Very High | Fair |

The addition of Sulfur Black 1 (Treatments SS-3-13-3 and SS-3-13-4, Table 5) in accordance with the present invention improves whiteness levels. Addition of copper gluconate (Treatment 2, Table 5) in accordance with the present invention enhances whiteness more and creates a very absorbent substrate. The combination of Sulfur Black 1 and copper gluconate demonstrates optimized conditions (Treatment SS 3-13-3, Table 5).

(concentrations in % owg if not stated otherwise)

TABLE 6

| | EK-4-87-1 | EK-4-87-2 | EK-4-87-3 |
|---|---|---|---|
| Non-foaming scouring/wetting agent | 0.7 | 0.7 | 0.7 |
| Peroxide Stabilizer | 0.5 | 0.5 | 0.5 |
| Trisodium Citrate | 2 | 2 | 2 |
| Copper Gluconate (ppm Cu owb) | | 0.5 | |
| Titanium Dioxide (ppm owb) | | | 1 |
| Sulfur Black 1 (ppm owb) | 5 | | |
| Hydrogen Peroxide (50%) | 3 | 3 | 3 |
| Caustic Soda (50%) | 0.4 | 0.4 | 0.4 |
| Treatment Time at 110° C. (min.) | 20 | 20 | 20 |
| Initial pH of bath | 10.7 | 10.4 | 10.4 |

TABLE 6-continued

| | EK-4-87-1 | EK-4-87-2 | EK-4-87-3 |
|---|---|---|---|
| Final pH of bath | 8.3 | 7.4 | 8.2 |
| Results on 100% cotton interlock knit: | | | |
| Whiteness (CIE) after treatment | 59.6 | 62.4 | 62.1 |
| Hydrophilicity | Poor | Very high | Poor |

As previously mentioned hereinabove, the addition of Sulfur Black 1 in accordance with the present invention improves whiteness levels. As shown by Treatments EK-4-87-1 (Table 6) and EK-4-87-3 (Table 6), replacement of 5 ppm Sulfur Black 1 pigment with 1 ppm Titanium Dioxide pigment enhances whiteness further in accordance with the present invention.

(concentrations in % owg if not stated otherwise)

TABLE 7

| | EK-4-90-1 | EK-4-90-2 | EK-4-90-3 | EK-4-90-4 |
|---|---|---|---|---|
| Non-foaming scouring/wetting agent | 0.7 | 0.7 | 0.7 | 0.7 |
| Peroxide Stabilizer | 0.5 | 0.5 | 0.5 | 0.5 |
| Trisodium Citrate | 2 | 2 | 2 | 2 |
| Copper Gluconate (ppm Cu owb) | 0.5 | 0.5 | 0.5 | 0 5 |

TABLE 7-continued

| | EK-4-90-1 | EK-4-90-2 | EK-4-90-3 | EK-4-90-4 |
|---|---|---|---|---|
| Titanium Dioxide (ppm owb) | | 2.5 | 5 | 3.3 |
| Sulfur Black 1 (ppm owb) | 5 | 2.5 | | 1.7 |
| Hydrogen Peroxide (50%) | 3 | 3 | 3 | 3 |
| Caustic Soda (50%) | 0.4 | 0.4 | 0.4 | 0.4 |
| Treatment Time at 110° C. (min.) | 20 | 20 | 20 | 20 |
| Initial pH of bath | 10.4 | 10.2 | 10.2 | 10.5 |
| Final pH of bath | 7.4 | 7.6 | 7.8 | 7.6 |
| Results on 100% cotton interlock knit: | | | | |
| Whiteness (CIE) after treatment | 65.2 | 65.9 | 67.9 | 67.2 |
| Hydrophilicity | Very high | Very high | Very high | Very high |

Replacement of Sulfur Black 1 pigment (Treatment EK-4-90-1, Table 7) with Titanium Dioxide pigment (Treatment EK-4-90-3, Table 7) enhances whiteness levels. All treatments in accordance with the present invention, as shown in Table 7, result in perfectly prepared cotton substrates.

(concentrations in % owg if not stated otherwise)

TABLE 8

| | EK-4-95-1 | EK-4-95-2/9 | EK-4-95-6 | EK-4-95-7 | EK-4-95-8 |
|---|---|---|---|---|---|
| Non-foaming scouring/wetting agent | 0.5 | 0.5 | 0.5 | 0.5 | 0.5 |
| Peroxide Stabilizer | 0.7 | | | | |
| Sodium Gluconate (60%) | | 0.2 | 0.2 | 0.2 | 0.2 |
| Trisodium Citrate | | 0.5 | 0.5 | 0.5 | 0.5 |
| $MgSO_4 \times 6\ H_2O$ | | 0.25 | 0.25 | 0.25 | 0.25 |
| Sulfur Black 1 (ppm owb) | | 8 | | | 2.2 |
| Titanium Dioxide (ppm Ti owb) | | | 4.4 | 13.2 | 8.8 |
| Copper Gluconate (ppm Cu owb) | | 0.54 | 0.54 | 0.54 | 0.54 |
| Urea | | 0.2 | 0.2 | 0.2 | 0.2 |
| Hydrogen Peroxide (50%) | 3 | 3 | 3 | 3 | 3 |
| Caustic Soda (50%) | 4 | 0.8 | 0.8 | 0.8 | 0.8 |
| Treatment Time at 110° C. (min.) | 20 | 20 | 20 | 20 | 20 |
| Initial pH of bath | 12.0 | 11.4 | 11.2 | 11.0 | 11.0 |
| Final pH of bath | 11.0 | 8.3 | 8.3 | 8.3 | 8.3 |
| Results on 100% cotton interlock knit: | | | | | |
| Whiteness (CIE) after treatment | 70.7 | 59.6 | 62.7 | 62.7 | 62.3 |
| Hydrophilicity | High | Very high | Very high | Very high | Very high |

Treatment EK-4-95-1 (Table 8) represents a typical prior art bleach. The final pH of 11.0 of Treatment EK-4-95-1 (Table 8) requires multiple rinses. All other treatments in accordance with the present invention shown in Table 8 lead to highly acceptable preparation results without the need for rinsing.

The invention claimed is:

1. A textile treatment bath composition for pre-treating a cellulosic, or cellulosic blends with synthetic fiber, substrate prior to dyeing comprising:

at least 90% water;

a non-foaming scouring/wetting agent;

a first activating compound formed of a mixture of urea and copper gluconate;

optionally, a second activating compound selected of a pigment;

caustic soda; and hydrogen peroxide;

wherein said textile treatment bath composition starts with a slightly alkaline pH.

2. A textile treatment bath composition according to claim 1, wherein said second activating compound is a pigment selected from pigmented Sulfur Black 1 with a particle size less than 150 μm, titanium dioxide with a particle size less than 150 μm, fully pre-oxidized sulfur dyes, and combinations thereof.

3. A textile treated with the textile treatment bath composition of claim 1, wherein the textile is selected from the group consisting of cellulosic textiles and cellulosic blends with synthetic fiber textiles.

* * * * *